US010072804B2

(12) United States Patent
Deng et al.

(10) Patent No.: US 10,072,804 B2
(45) Date of Patent: Sep. 11, 2018

(54) TABLE LAMP AND A METHOD OF ADJUSTING THE DIRECTION OF THE LIGHT OUTPUT FROM A TABLE LAMP

(71) Applicant: PHILIPS LIGHTING HOLDING B.V., Eindhoven (NL)

(72) Inventors: Xiaoliang Deng, Eindhoven (NL); Guo Jiang Wang, Eindhoven (NL); Wan Xuan Lim, Eindhoven (NL); Yaoling Hu, Eindhoven (NL); Changxun Ke, Eindhoven (NL); Jianzhi Lou, Eindhoven (NL); Tingting Gao, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 5 days.

(21) Appl. No.: 15/511,632

(22) PCT Filed: Sep. 11, 2015

(86) PCT No.: PCT/EP2015/070781

§ 371 (c)(1),
(2) Date: Mar. 15, 2017

(87) PCT Pub. No.: WO2016/041850

PCT Pub. Date: Mar. 24, 2016

(65) Prior Publication Data

US 2017/0307151 A1 Oct. 26, 2017

(30) Foreign Application Priority Data

Sep. 19, 2014 (WO) ..... PCT/CN2014/086937
Oct. 31, 2014 (EP) ..... 14191201

(51) Int. Cl.

| | |
|---|---|
| ***F21S 6/00*** | (2006.01) |
| ***F21V 23/06*** | (2006.01) |
| ***F21V 14/04*** | (2006.01) |
| ***F21V 7/00*** | (2006.01) |
| ***F21V 19/02*** | (2006.01) |
| *F21Y 115/10* | (2016.01) |

(52) U.S. Cl.
CPC ..... *F21S 6/003* (2013.01); *F21V 7/0083* (2013.01); *F21V 14/04* (2013.01); *F21V 19/02* (2013.01); *F21V 23/06* (2013.01); *F21Y 2115/10* (2016.08)

(58) Field of Classification Search
CPC ..... F21V 7/0083; F21V 14/04; F21V 19/02; F21V 23/06; F21S 6/003
USPC ..... 362/652, 647, 657, 659, 410
See application file for complete search history.

(56) References Cited

U.S. PATENT DOCUMENTS 4,298,919 A * 11/1981 Karasawa ..... H01R 33/46 362/365
5,931,556 A 8/1999 Herst
(Continued)

FOREIGN PATENT DOCUMENTS

CN 201916783 U 8/2011
DE 20109734 U1 10/2001
DE 202007004787 U1 8/2007
(Continued)

*Primary Examiner* — Laura Tso

(57) ABSTRACT

A table lamp has a lighting head with an asymmetrical light output. The lighting head is reversibly mountable to a support structure, so that the light output can be adapted to be optimized for positioning on either side (left or right) of a table.

14 Claims, 4 Drawing Sheets

(56) References Cited

U.S. PATENT DOCUMENTS

| | | | | |
|---|---|---|---|---|
| 7,441,930 | B2 * | 10/2008 | Lin | F21S 6/003<br>362/410 |
| 2003/0185003 | A1 * | 10/2003 | Laukhuf | H01R 13/641<br>362/652 |

FOREIGN PATENT DOCUMENTS

| | | | |
|---|---|---|---|
| DE | 202008004795 | U1 | 7/2008 |
| EP | 2527720 | A1 | 11/2012 |
| GB | 2005995 | A | 5/1979 |
| GB | 2184649 | A | 7/1987 |
| JP | 2008269974 | A | 11/2008 |

* cited by examiner

TABLE LAMP AND A METHOD OF ADJUSTING THE DIRECTION OF THE LIGHT OUTPUT FROM A TABLE LAMP

CROSS-REFERENCE TO PRIOR APPLICATIONS

This application is the U.S. National Phase application under 35 U.S.C. § 371 of International Application No. PCT/EP2015/07081, filed on Sep. 11, 2015 which claims the benefit of Chinese Patent Application No. PCT/CN2014/086937, filed on Sep. 19, 2014 and European Patent Application No. 14191201.4, filed on Oct. 31, 2014. These applications are hereby incorporated by reference herein.

FIELD OF THE INVENTION

This invention relates to table lamps, and to adjustment of the direction in which lighting is provided by a table lamp.

BACKGROUND OF THE INVENTION

Normally, light generated by table lamps, for example LED table lamps, is symmetrically distributed. However, it is desirable for target objects or areas which require lighting to be located at one side of the table lamp, so that the table lamp can be situated to the side of the table, out of the way of the working area.

Light output by the table lamp to the other side is then wasted, reducing the efficient usage of light. In addition, when table lamps are put on a level desk and turned on, the brightest spot is right under the lamp. To make use of the brightest spot to illuminate an object, a user must move the table lamp closer or tilt the lamp, which for example makes reading uncomfortable or produces glare. There may also be a tendency to bend over a desk in order to move closer to the brightest area, which may be harmful to the eyesight of the user because of the short focus distance.

It has been proposed to provide a table lamp with an asymmetrical light output, for example in GB 2 005 995.

However, providing an asymmetrical output gives rise to limitations to the adjustment of the light output direction. For example, it may require the lamp to be in a fixed position relative to a table, which may be inconvenient for the user, depending on the work they are carrying out, and/or depending on their preference for the position of the table lamp. This preference may for example depend on whether the user is left-handed or right-handed. Users often put table lamps at the front-left or front-right of the table according to their handedness. A right-handed user typically puts the table lamp on the front-left (or back-left) of a desk in order not to block light and therefore cast a shadow on the work piece with their right hand. Similarly, a left-handed user typically puts the table lamp on the front-right (or back-right) of the desk.

A table lamp with asymmetrical light output will not therefore be optimised for positioning in different alternative places. This invention aims to address this problem.

SUMMARY OF THE INVENTION

The invention is defined by the claims.

Examples of one aspect of the invention provide a table lamp, comprising:

a support structure; and a lighting head having first and second opposite ends, which is adapted to generate a light output having an asymmetrical cross section in a plane that is perpendicular to a line connecting the first and second ends of the lighting head, wherein the support structure has an electrical connector and a mechanical connector for connecting to the lighting head, and wherein the lighting head has an electrical connector and a mechanical connector at each end for connecting to the support structure, such that the lighting head is reversibly mountable.

By providing a lighting head with an asymmetric output in the side-to-side direction, the lamp can be placed to the side of a table, and illuminate a working area of the table without being in the way of the user. The reversible design of the lighting head means the table lamp can be placed on either side of a table, to suit left-handed and right-handed people, by swapping over the orientation of the lighting head. The electrical connectors on the support structure and the lighting head are adapted to connect to each other, and the mechanical connectors on the support structure and the lighting head are adapted to connect to each other.

The lighting head is preferably rotatably adjustable where it connects to the support structure, about an axis parallel to the end-to-end direction of the lighting head. Adjustment about this parallel axis enables the degree to which the light is cast sideways to be adjusted, for example to suit tables of different widths. The adjustment comprises side-to-side swivelling of the lighting head.

The lighting head is preferably also (or alternatively) rotatably adjustable where it connects to the support structure about an axis perpendicular to the elongate axis of the lighting head. Adjustment about this perpendicular axis may enable the degree to which the light is cast forward and back to be adjusted, for example to suit tables of different depths. The adjustment comprises changing the elevation angle of the lighting head.

The lighting head may comprise an end cap for mounting over the end of the lighting head which is not connected to the support structure. The end cap covers the unused electrical contact for safety reasons as well as providing improved aesthetic appearance.

The lighting head may comprise a housing containing a light source arrangement, an upper reflector arrangement and a lower diffusing output window which defines a lower face of the housing, wherein the light source arrangement is directed towards the upper reflector arrangement. The upper reflector can be designed to provide the desired asymmetrical illumination shape. It avoids the light source being directly visible, and the diffusing window further enhances the uniformity of the light output.

The housing may contain a metal support on which the light source arrangement is mounted. This metal support may function as a mechanical support and as a heat sink.

The lighting head preferably comprises an array of LEDs arranged along a direction parallel to the end-to-end direction of the lighting head, each LED having an associated beam shaping reflector arrangement. The beam shaping reflector arrangement provides initial beam shaping before the light reaches the upper reflector arrangement.

The electrical connector of one of the lighting head and the support structure (e.g. the lighting head) preferably comprises a push fit electrical connector housed within a surrounding mechanical connector. The mechanical connector in this way provides shielding of the electrical connector so that the electrical contacts are not exposed to the user. The mechanical connector then may comprise an annular recess, wherein the electrical connector comprises a projecting pin connector at the bottom of the recess. The pin connector can be located at the centre of the annular recess, so that the connector can be rotated about the axis of the pin connector. It also means that the corresponding electrical connector of the other one of the lighting head and the support structure is a recess rather than a pin, which improves safety.

The mechanical connector of the other one of the lighting head and the support structure (e.g. the support structure) for example comprises a projecting plug, wherein the electrical connector comprises a recessed socket at the end of the projecting plug.

The mechanical connector of the other one of the lighting head and the support structure (e.g. the support structure) may comprise one or more sealing rings around the projecting plug. These function to secure and stabilise the lighting head on the support structure.

In one example, the support structure comprises a base and at least two arms articulated with respect to each other between the base and the lighting head. This enables a good degree of adjustment to be made.

Examples of another aspect of the invention provide a method of adjusting the direction of the light output from a table lamp, wherein the table lamp comprises a support structure and a lighting head having first and second opposite ends, which is adapted to generate a light output having an asymmetrical cross section in a plane that is perpendicular to a line connecting the first and second ends of the lighting head, wherein the method comprises selecting an end-to-end orientation with which the lighting head should be mounted to the support structure to achieve a desired lighting effect; and mounting the lighting head to the support structure with the selected end-to-end orientation, thereby providing mechanical and electrical coupling between the lighting head and the support structure.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a table lamp in which a lighting head with an asymmetrical light output is reversibly mountable to a support structure, so that the light output can be adapted to be optimised for positioning on either side (left or right) of a table.

Usually, users require a rectangular illuminated area for conducting tasks using paper documents. Light projected in this rectangular area should be bright and uniform. If an asymmetrical light distribution is provided by a table lamp, light generated by the light sources is guided to one side and projected to a rectangular area, which not only save energy, but also matches the typical desired positioning by users. The reversible lighting head enables the table lamp to be configured for both right-handed and left-handed users.

Figure 1:
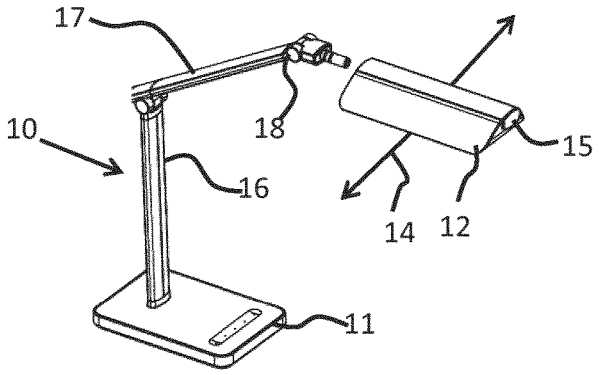
FIG. 1 shows a table lamp according to an example of the invention.

FIG. 1 shows a table lamp, comprising a support structure 10 and a lighting head 12 which is removably attachable to the support structure 10. The support structure for example comprises a base 11 which is for resting on a surface of the table. However, it may instead comprise a clamp for gripping a table edge.

The lighting head 12 is generally elongate, and has first and second opposite ends. The lighting head is adapted to generate a light output which is asymmetrical in a sideways direction, perpendicular to the end-to-end direction, of the lighting head. This sideways direction is shown as 14, which means a plane that is perpendicular to a line connecting the first and second ends of the lighting head. The lighting head is adapted to generate a light output having an asymmetrical cross section in the plane.

The support structure 10 and the lighting head 12 each have an electrical connector and a mechanical connector for connecting the two components together. The lighting head has identical electrical and mechanical connectors at both ends, such that the lighting head is reversibly mountable on the support structure. An end cap 15 covers the exposed end.

The asymmetric light output means the light is cast preferentially to one side of the lighting head so that the lamp can be placed to one side of a table. The reversible design means the table lamp can be placed on either side of a table, to suit left-handed and right-handed people, by swapping over the orientation of the lighting head 12.

In the example shown, the support structure comprises the base 11 and two arms 16,17 articulated with respect to each other, between the base 11 and the lighting head 12. This enables a good degree of adjustment to be made.

In the example shown, the lighting head is rotatably adjustable where it connects to the support structure 10 about an axis perpendicular to the elongate axis of the lighting head. This axis of rotation is shown as 18. Adjustment about this perpendicular axis enables the degree to which the light is cast forward and back to be adjusted, for example to suit tables of different depths. The adjustment comprises changing the elevation angle of the lighting head, if the axis of rotation 18 is arranged to be horizontal, i.e. parallel to the plane of the base 11.

The lighting head is also rotatably adjustable where it connects to the support structure 10, about an axis parallel to the end-to-end direction of the lighting head. Adjustment about this parallel axis enables the degree to which the light is cast sideways to be adjusted, for example to suit tables of different widths. The adjustment comprises side-to-side swivelling of the lighting head. The lighting head is for example rotatable along this axis by 360°. This means light can be projected upwards, downwards, left and right around the axis, which greatly facilitates different user habits and different task area requirements. It may be used not only to light up the table, but also it may project to a wall as background lighting, or project to targeted objects which are near the table.

The way the light output direction from the table lamp can be adjusted is explained with reference to FIGS. 2 to 5.

Figure 2:
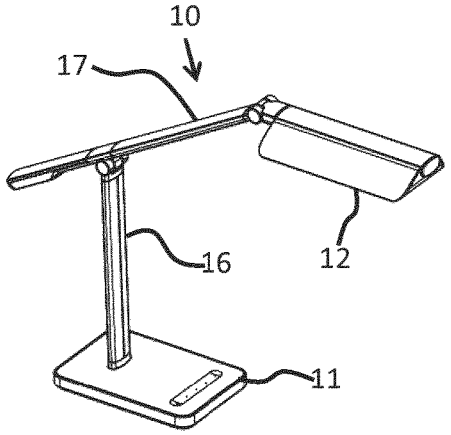
FIGS. 2 to 5 show the table lamp of FIG. 1 being reconfigured by changing the orientation of the lighting head.
Figure 3:
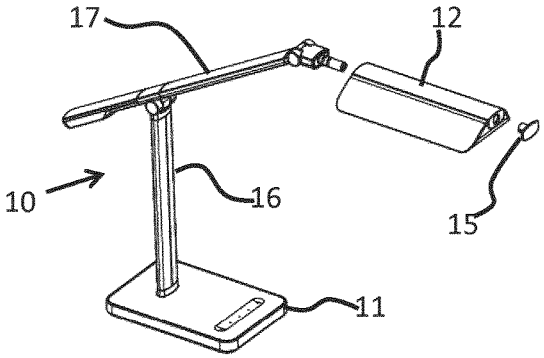

FIG. 2 shows the table lamp with the lighting head mounted in a first orientation. FIG. 3 shows the lighting head removed from the support structure 10 and the end cap 15 removed. The coupling between the lighting head 12 and the support structure 10 can for example be a push fit connection, although other connections are possible.

Figure 4:
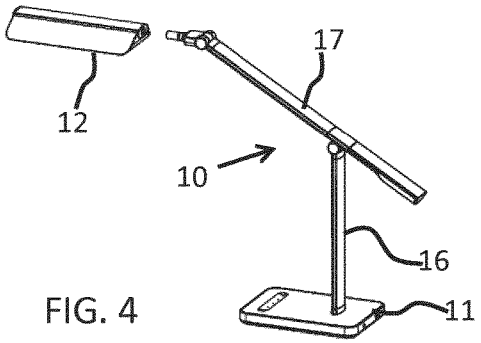
Figure 5:
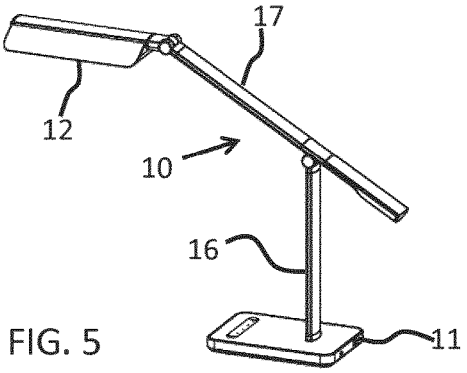

FIG. 4 shows the lighting head rotated by 180 degrees so that the other end is facing the support structure 10. FIG. 5 shows the lighting head and the support structure reconnected.

Figure 6:
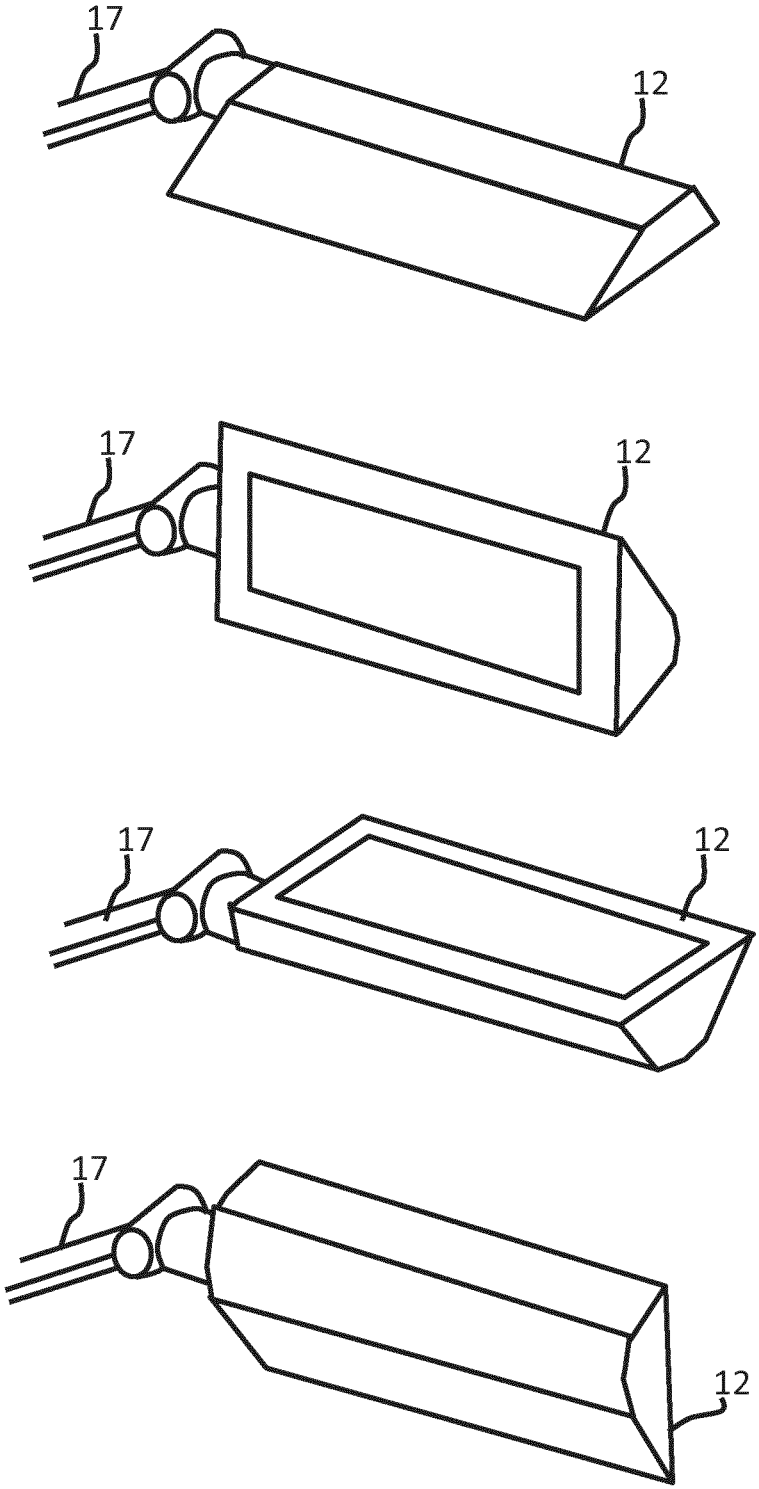
FIG. 6 shows four rotational positions for the lighting head about an axis parallel to the elongate axis.

FIG. 6 shows four rotational positions for the lighting head about the axis parallel to the elongate axis. The four positions are every 90 degrees to show the full 360 degree adjustment that can be made. As shown, the illumination direction can be up, down, or to either side (assuming the axis of rotation is horizontal).

Figure 7:
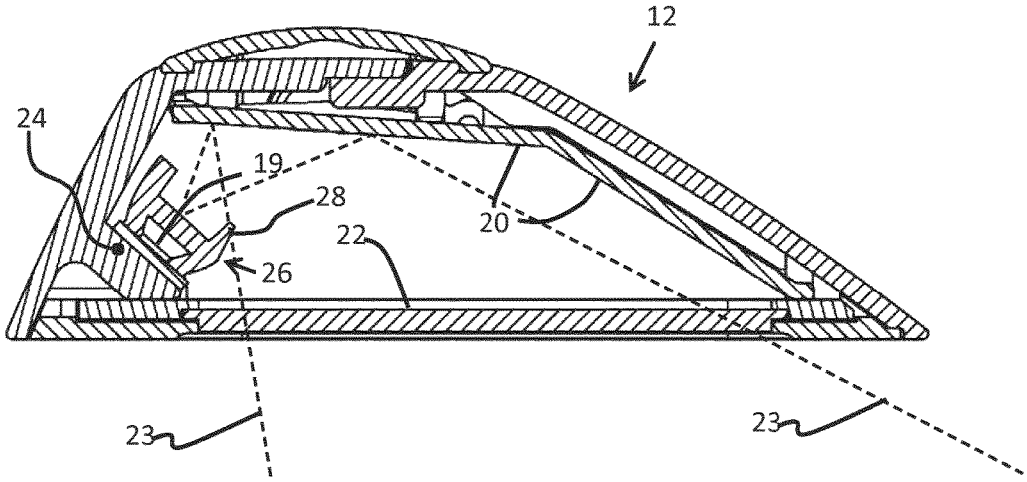
FIG. 7 shows the design of the lighting head in more detail in cross section across the length direction.

FIG. 7 shows one possible example of the lighting arrangement inside the lighting head 12, as a cross section perpendicular to the end-to-end direction.

The lighting head 12 comprises a housing containing a light source arrangement. In the example shown, the light source arrangement comprises a set of LEDs 19, although other light sources can be used. The light source arrangement produces a generally upwardly directed light output, and an upper reflector arrangement 20 is used to redirect the light to a downward direction, with the desired asymmetry. A lower diffusing output window 22 defines a lower face of the housing. The upper reflector arrangement 20 avoids the light source being directly visible, and the diffusing window further enhances the uniformity of the light output.

The housing has a metal support 24 on which the light source arrangement is mounted to provide a heat sink.

The housing itself has an asymmetrical shape, a thicker side having the light source arrangement and the other side thinner. Light is projected preferentially to the thinner side as represented by the approximate light envelope boundary lines 23.

The housing shape does not need to be asymmetrical from an optical point of view, but it matches the asymmetry of the lighting system so as to help users to identify which side of the lighting head is the preferential light projection side.

In one example, the light source arrangement comprises an LED module 26 with an associated reflector array comprising reflectors 28 for initial beam shaping.

Figure 8:
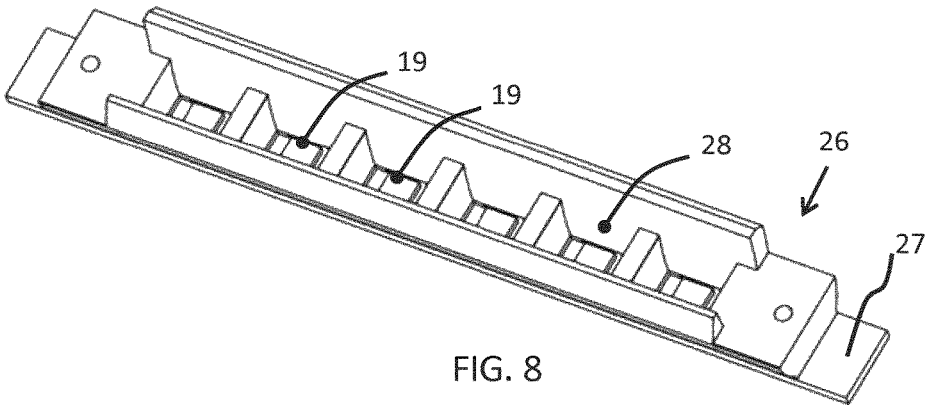
FIG. 8 shows an LED module and associated reflector arrangement used in the lighting head.

As shown in FIG. 8, the LED module 26 comprises an array of LEDs 19 mounted on a PCB 27 arranged along a direction parallel to the end-to-end direction of the lighting head, each LED 19 having an associated beam shaping reflector 28.

The housing can be formed as a closed optical cavity, which protects the internal components from pollution or damage from external objects. The ends of the housing are closed by decorative end covers, which close the optical cavity.

In one example, the angle between the LED emission surface normal and the diffuser surface is around 48°. The beam shaping reflectors 28 can generate, from the light emitted from LED sources, a rectangular distribution. This rectangular distribution is then projected to the upper reflector arrangement 20, which has two neighbouring surfaces, for example at an angle of around 152°. This generates the asymmetrical output, generally to a rectangular illumination area but offset towards one side of the lighting head 12. The angle between the upper reflecting surface 20 furthest from the light source arrangement and the diffuser is for example around 32°.

Based on the lumen output requirement of the table lamp, different powers and numbers of LED light sources, together with corresponding different numbers of associated beam shaping reflectors 28, should be applied. FIG. 8 shows an LED module with six LED units simply by way of example.

Figure 9:
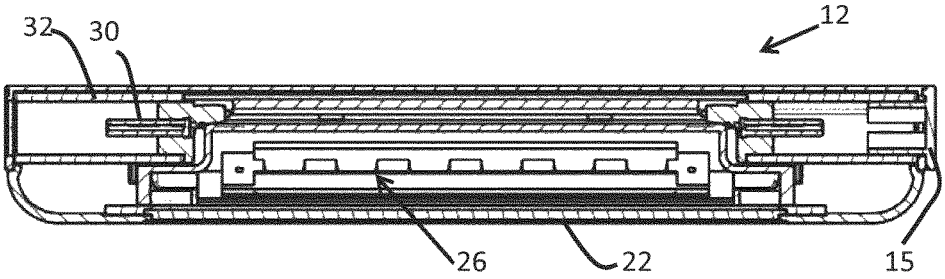
FIG. 9 shows the lighting head in cross section along the length direction, with the electrical and mechanical connector shown more clearly.

FIG. 9 shows a cross section parallel to the elongate axis and shows the connectors at each end.

The connectors are designed for push-pull application and release. The coupling between the lighting head and the support structure implements both a mechanical and an electrical connection. The mechanical and electrical connectors on both ends are the same, so that the lighting head is reversible.

The electrical connector of the lighting head 12 comprises an electrical pin connector 30 housed within a surrounding recess 32 which defines the mechanical connector. The mechanical connector in this way provides shielding of the electrical pin connector 30 so that the electrical contacts are not exposed to the user, so that they are not easily damaged, and also so that the non-connected end of the lighting head does not have exposed contacts.

The pin connector is located at the centre of the recess 32, so that the connector can be rotated about the axis of the pin, for the rotational side-to-side swivelling explained above.

The pin connector may comprise a pair of coaxial contacts (such as a jacket connector comprising an annular cylindrical projection with inner and outer contacts, or a coaxial connector with an inner pin and a surrounding annular connector) or it may have contacts at different positions along its length (such as a headphone jack connector). Internal wires connect the pin connectors to the LED module 26 of the lighting system.

The end cap 15 closes and covers the unused recess 32.

Figure 10:
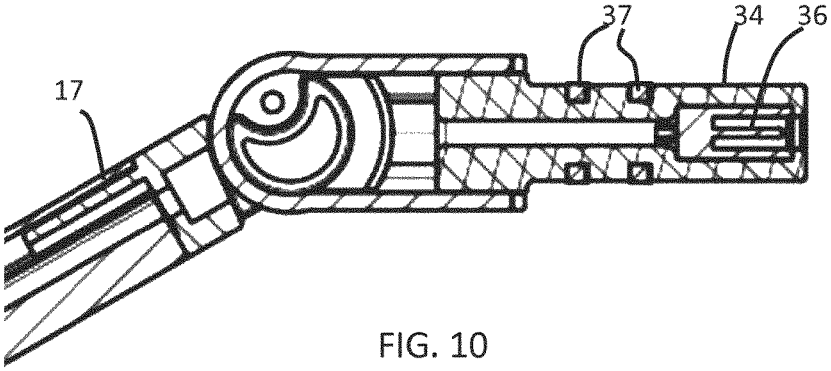
FIG. 10 shows the support structure in cross section along the length direction, with the electrical and mechanical connector shown more clearly.

FIG. 10 shows the corresponding mechanical and electrical connectors of the support structure, at the end of the arm 17. The mechanical connector of the support structure is in the form of a projecting plug 34, and the electrical connector of the support structure comprises a recessed socket 36 at the end of the projecting plug. The use of a recess rather than a pin also improves safety when the lighting head is removed.

Of course, the support structure may instead have a shielded electrical pin connector, and the lighting head may instead have a recessed electrical connector. Thus, the connector designs may be reversed.

The length of the recess 32 and the plug 34 are chosen to achieve the desired mechanical stability.

Two sealing rings 37 are shown around the projecting plug 34. These function to secure and stabilise the lighting head on the support structure. They also provide a friction force for resisting free rotation.

The electrical connector is for mating with the connector of the lighting head, and thus may comprise a female jack connector, or a female jacket connector.

The lighting head is reversible but also rotatable by 360°. A friction force is used to hold the lighting head steadily during adjustment. The sealing rings 37 could be independent parts which are mounted to the shaft shaped mechanical connector, or else they can be combined to the mechanical plug connector by secondary injection. More or less than two rings may be needed.

Figure 11:
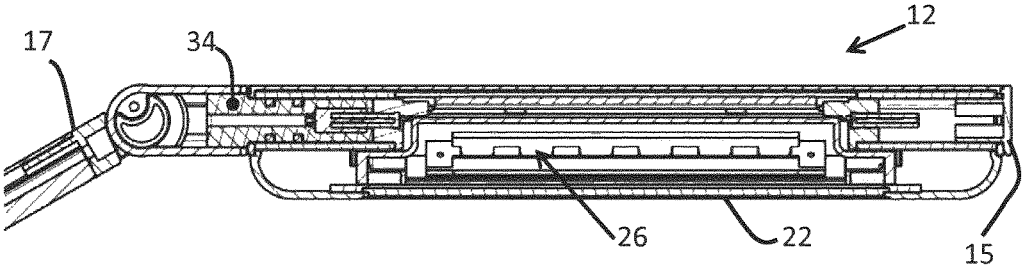
FIG. 11 shows the lighting head of FIG. 9 coupled to the support structure of FIG. 10.

FIG. 11 shows the lighting head and support structure coupled together.

When setting the orientation of the lighting head, an end-to-end orientation is selected with which the lighting head should be mounted to the support structure to achieve a desired lighting effect. The lighting head is then mounted to the support structure with the selected end-to-end orientation.

The light output of the lighting head is designed to conform to applicable national standards for desk lighting.

The invention can be applied to LED lighting to other lighting technologies. Only one example of two-arm support is shown, but the support structure may be simpler (such as a simple upright) or more complicated. These variations do not alter the concept of an asymmetric reversible lighting head.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A table lamp, comprising:

a support structure; and a lighting head having first and second opposite ends, which is adapted to generate a light output having an asymmetrical cross section in a plane that is perpendicular to a line connecting the first and second ends of the lighting head, wherein the support structure has an electrical connector and a mechanical connector for connecting to the lighting head, and wherein the lighting head has an electrical connector and a mechanical connector at each end for connecting to the support structure, such that the lighting head is reversibly mountable.

2. A table lamp as claimed in claim 1, wherein the lighting head is rotatably adjustable where it connects to the support structure, about an axis parallel to the end-to-end direction of the lighting head.

3. A table lamp as claimed in claim 2 wherein the lighting head is rotatably adjustable by 360 degrees about the axis parallel to the end-to-end direction of the lighting head.

4. A table lamp as claimed in claim 1, wherein the lighting head is rotatably adjustable where it connects to the support structure about an axis perpendicular to the elongate axis of the lighting head.

5. A table lamp as claimed in claim 1, wherein the lighting head comprises an end cap for mounting over the end of the lighting head which is not connected to the support structure.

6. A table lamp as claimed in claim 1, wherein the lighting head comprises a housing containing a light source arrangement, an upper reflector arrangement and a lower diffusing output window which defines a lower face of the housing, wherein the light source arrangement is directed towards the upper reflector arrangement.

7. A table lamp as claimed in claim 6, wherein the housing contains a metal support on which the light source arrangement is mounted.

8. A table lamp as claimed in claim 1, wherein the lighting head comprises an array of LEDs arranged along a direction parallel to the end-to-end direction of the lighting head, each LED having an associated beam shaping reflector arrangement.

9. A table lamp as claimed in claim 1, wherein the electrical connector of one of the lighting head and the support structure comprises a push fit electrical connector housed within a surrounding mechanical connector.

10. A table lamp as claimed in claim 9, wherein the mechanical connector of said one of the lighting head and the support structure comprises an annular recess, wherein the electrical connector of said one of the lighting head and the support structure comprises a projecting pin connector at the bottom of the recess.

11. A table lamp as claimed in claim 9, wherein the mechanical connector of the other one of the lighting head and the support structure comprises a projecting plug, wherein the electrical connector of said other one of the lighting head and the support structure comprises a recessed socket at the end of the projecting plug.

12. A table lamp as claimed in claim 11, wherein the mechanical connector of said other one of the lighting head and the support structure comprises one or more sealing rings around the projecting plug.

13. A table lamp as claimed in claim 1, wherein the support structure comprises a base and at least two arms articulated with respect to each other between the base and the lighting head.

14. A method of adjusting the direction of the light output from a table lamp, wherein the table lamp comprises a support structure and a lighting head, having first and second opposite ends, which is adapted to generate a light output having an asymmetrical cross section in a plane that is perpendicular to a line connection the first and second ends of the lighting head, wherein the method comprises selecting an end-to-end orientation with which the lighting head should be mounted to the support structure to achieve a desired lighting effect; and mounting the lighting head to the support structure with the selected end-to-end orientation, thereby providing mechanical and electrical coupling between the lighting head and the support structure.

* * * * *